US006041933A

United States Patent [19]

Baker

[11] Patent Number: 6,041,933

[45] Date of Patent: Mar. 28, 2000

[54] NESTABLE AND STACKABLE TWO-PIECE DUNNAGE

[75] Inventor: Jay J. Baker, Mayville, N.Y.

[73] Assignee: Jamestown Plastics, Inc., Brocton, N.Y.

[21] Appl. No.: 09/241,894

[22] Filed: Feb. 1, 1999

[51] Int. Cl.[7] ..... B65D 85/20

[52] U.S. Cl. ..... 206/564; 206/335; 206/443; 206/587

[58] Field of Search ..... 206/419, 422, 206/443, 485, 564, 594, 335, 587, 589; 211/60.1, 70.1

[56] References Cited

U.S. PATENT DOCUMENTS

| | | | |
|---|---|---|---|
| 1,367,600 | 2/1921 | Hirsch | 206/485 |
| 2,426,899 | 9/1947 | Pantalone | 206/485 |
| 3,084,790 | 4/1963 | Vander Lugt, Jr. . | |
| 3,384,228 | 5/1968 | Cannon | 206/485 |
| 3,608,706 | 9/1971 | Vigue | 206/422 |
| 3,747,751 | 7/1973 | Miller et al. | 206/564 |
| 3,955,681 | 5/1976 | DeZinno . | |
| 4,341,308 | 7/1982 | Pasquini | 206/485 |
| 4,586,615 | 5/1986 | Quitmann . | |
| 4,705,170 | 11/1987 | Creaden | 206/419 |
| 4,848,573 | 7/1989 | Salacuse | 206/564 |
| 4,921,101 | 5/1990 | Gatt . | |
| 5,178,279 | 1/1993 | Carroll . | |
| 5,259,507 | 11/1993 | Smith . | |
| 5,339,958 | 8/1994 | Taravella et al. . | |
| 5,474,171 | 12/1995 | Niesen et al. . | |
| 5,505,309 | 4/1996 | Taravella et al. | 206/485 |

*Primary Examiner*—Jim Foster
*Attorney, Agent, or Firm*—Alston & Bird LLP

[57] ABSTRACT

Dunnage for shipping densely packed objects is disclosed. The dunnage consists of trays for supporting objects. Each tray includes a plurality of alternating, spaced first and second bays. Each first bay is adapted to hold one end of the object, while each second bay is adapted to hold the second end of the object. Matched first/second bay pairs are formed when two trays are placed with their bay openings facing one another. This allows each object to be retained by a first/second bay pair. To stack non-linear and symmetric objects in a high vertical density, a second set of trays is stacked on top of the first set of trays. The trays of the second set of trays are different in that the order of bays are opposite the order of bays in the first set of trays. This allows for opposite first/second bay pairs and greater vertical density.

7 Claims, 2 Drawing Sheets

NESTABLE AND STACKABLE TWO-PIECE DUNNAGE

FIELD OF THE INVENTION

The invention relates generally to dunnage used for shipping a plurality of identical objects, and more specifically, to dunnage for the dense packing of non-linear, symmetric objects that prevents the supported objects from striking or rubbing against one another during transit.

BACKGROUND OF THE INVENTION

Shipping products in densely packed containers can often damage the products. Vibration, shifting, and rubbing of the products against one another and the supporting dunnage can cause breakage, scratching, and scoring. This is a more significant concern for products having finished or ornamental surfaces. For example, many automobile parts have a decorative surface (e.g., molding and chrome strips) that must be protected during transit from the OEM supplier to the automobile manufacturer. Stacking dividers exist to separate such products during transit, but that retain acceptable density of the products during. Many of these dividers work by placing a divider at opposite walls within a box or crate and suspending the product across the dividers. U.S. Pat. No. 5,178,279 to Carroll is an example. The '279 patent discloses a one-piece stacking divider tray that protects automotive trim moldings from marring during transit. Each tray includes a plurality of bunkers separated by posts. Each piece of molding fits between two posts with its non-decorative surface resting on a bunker. The posts separate the molding strips and prevent contact between the molding strips. Additionally, the trays disclosed in the '279 patent stack on one another to increase packing density.

However, the trays of the '279 patent lose efficiency when supporting symmetrical, non-linear products. For example, automobile wiper arms are generally complex shapes best modeled as rods having a series of bends, both vertical and horizontal. Using the trays of the '279 patent to accommodate the non-linear shape of the wiper arm would decrease the packing density of wiper arms as more room, either vertical or horizontal, or both, must be given each wiper arm to account for its bends. Also, a wiper arm is normally a metal or metal and plastic construction that is completely painted and susceptible at all points to marring, scratching, and chipping. This is unlike the molding discussed in the '279 patent which has a non-decorative face that can contact dunnage without affecting the usefulness of the molding. Accordingly, all significant contact between the dunnage supports and wiper arms must be eliminated to prevent unacceptable marring, scratching, and chipping during transit.

Dunnage capable of (i) supporting non-linear, symmetrical products in a high-density packing configuration, (ii) preventing contact between the densely packed product during shipping and (iii) retaining the product at a minimum of contact with the dunnage would be desirable.

SUMMARY OF THE INVENTION

The invention is dunnage to prevent damage to objects during shipment at a high density. The dunnage comprises a set of first trays. Each first tray has a top, bottom and side surfaces. The side surface includes alternating, spaced first and second bays. Each first bay is adapted to retain the first end of an object, and each second bay is adapted to retain each second end of the same object. The two ends of the object are different from one another. The first trays are configured such that when the bays of two of these first trays are aligned with their bays opening towards one another, each first bay indexes with a second bay on the other first tray to form matched first/second bay pairs. Objects are retained by each first/second bay pair and prevented from contacting one another during shipping.

In another embodiment of the invention, the dunnage also includes a set of second trays. Each second tray also has a top, bottom and side surfaces and alternating, spaced first and second bays. The second trays are configured such that when the bays of two of the second trays are aligned with their bays opening towards one another, each first bay indexes with a second bay on the other second tray to form matched first/second bay pairs. Both the first trays and second bays in this embodiment include interlocking members on the their top and bottom surfaces. The interlocking members of the bottom surface of the second tray are adapted to mate with the interlocking numbers of the top surface of the first tray when the second tray completely overlays the first tray. Similarly, the interlocking members of the bottom surface of the first tray are adapted to mate with the interlocking portions of the top surface of the second tray when the first tray completely overlays the second tray. Importantly, the orientation and order of said first/second bay pairs of said first tray layer are opposite that of the first/second bay pairs of the second tray layer directly over the first tray layer. This allows dense packing of the objects in the vertical direction and reduces lateral movement of the first and second trays in relation to one another.

An object of the invention is to provide dunnage capable of densely stacking objects in both the horizonal and vertical direction.

Another object of the invention is to provide dunnage capable of densely packing non-linear, symmetric objects.

Another object of the invention is to provide dunnage that is made from relatively inexpensive materials that is simple to manufacture.

Still another object of the invention is to provide dunnage capable of nesting for easy storage when not in use, and stacking during use.

Yet another object of the invention is to provide dunnage where the objects suspended have as little contact with the dunnage as possible.

DETAILED DESCRIPTION OF THE PREFERRED EMBODIMENT OF THE INVENTION

Figure 1:
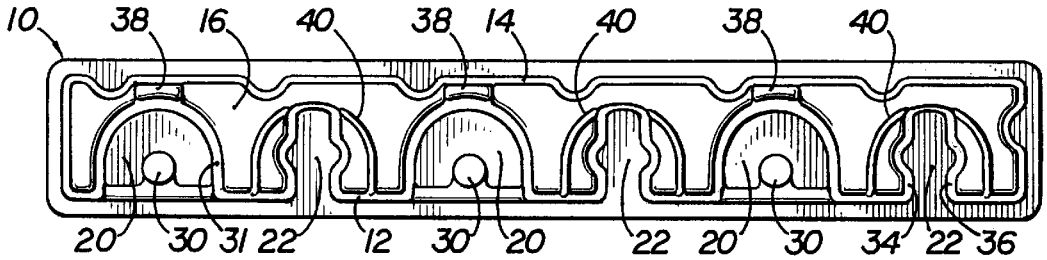
FIG. 1 is a top plan view of tray 10.

As described above, the invention relates to dunnage for non-linear, symmetric products, such as wiper arms for automobiles. Adverting to FIGS. 1 and 2, a tray 10 is shown to comprise front surface 12, rear surface 14, top surface 16, and bottom surface 18. Tray 10 is made of a strong, lightweight thermoplastic such as high impact polystyrene, such as Prime Impax 752 manufactured by Primex Plastics, Inc., of Richmond, Ind., at a thickness of 0.045". Other plastics such as high density, polyethylene, polypropylene, polyvinyl chloride AVS, PET and PETS could be used depending on the strength requirements for the product to be supported.

A series of bays exist in front surface 12. Two types of bays, post bays, severally indicated at 20, and canyon bays, severally indicated at 22, alternate in a one-to-one ratio along the length of front surface 12. Tray 10 includes three sets of post and canyon bays, 20 and 22. The invention contemplates trays of various lengths having varying numbers of bays, depending on the applicable requirements. Adverting to FIG. 3, two identical trays 10 are placed with their front surfaces 12 facing one another. Notice an even number of alternating bays 20 and 22 allows the two opposed trays 10 to form corresponding sets of post bays 20/canyon bays 22. This allows proper placement of wiper arms 24 between the trays 10. Post bays 20 are adapted to retain one end 26 of wiper arm 24 having an eye-hole 28. On an automobile, end 26 is connected to an actuating mechanism at the base of a windshield. Post 30 is hollow and partially surrounded by tapered wall 31, with post 30 and tapered wall connected by a base 29. Post 30 fits snugly into eye-hole 28 retaining end 26 from horizontal movement. Only a minimal portion of end 26 contacts tray 10, the interior of eye-hole 28 and an arc of the bottom of end 26. This minimizes wear due to rubbing.

Figure 2:
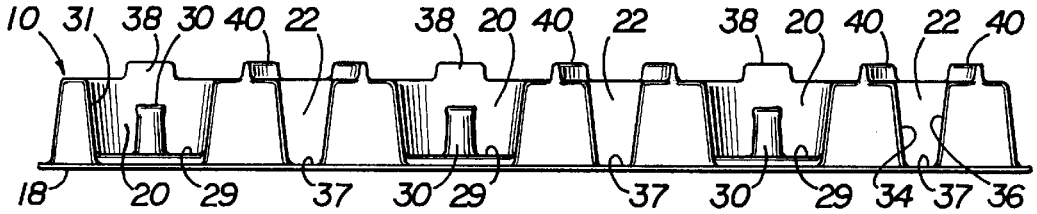
FIG. 2 is a front elevation view of the tray in FIG. 1.
Figure 3:
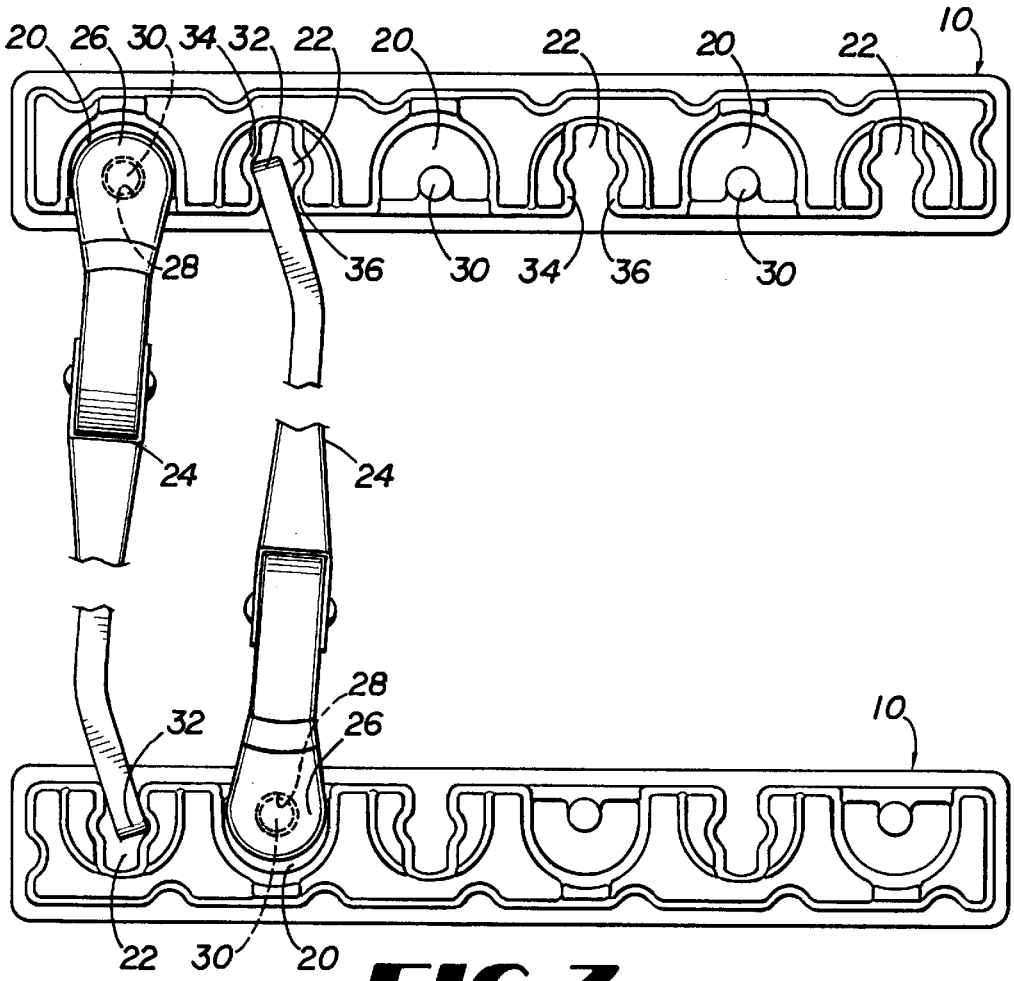
FIG. 3 is a top plan view of wiper arms retained by two trays 10.
Figure 4:
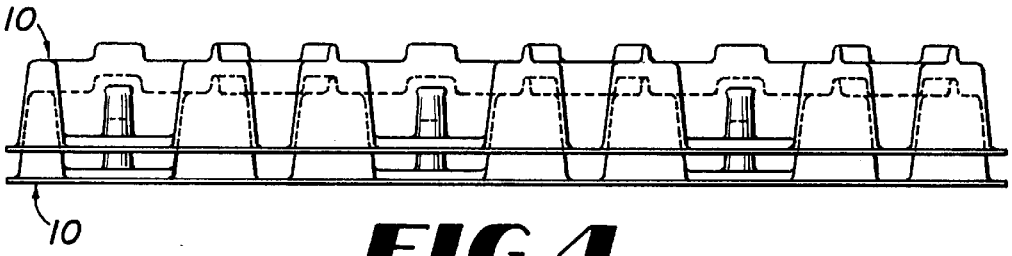
FIG. 4 is a front elevation of two nesting trays 10.

Canyon bays 22 are adapted to retain the second end 32 of wiper arm 24. On an automobile, end 32 is adapted to connect with a wiper blade assembly. FIG. 2 shows the V-shape of canyon 22. When end 32 is placed into canyon bay 22, it will proceed downward between walls 34 and 36 until resting on base 37. Walls 34 and 36 at base 37 are configured to closely emulate the shape of end 32, thus reducing movement of end 32 within canyon bay 22. Again, only minimal surface area of end 32 contacts tray 10. As shown in FIG. 3, wiper arms 24 are separated from one another and will not rub against or strike one another during transit. The interfaces between wiper arms 24 and trays 10 are minimized and there is a much smaller chance of marring, scratching, or scoring of wiper arm 24 at a plastic to metal interface than a metal to metal interface. Adverting to FIG. 4, tapered walls 31, 34, and 36 allow a plurality of trays to be nested one within another for compact storage when not in use.

When two trays 10 are placed facing one another, a plurality of wiper arms 24 can be placed between the two trays 10 with their ends 26 and 32 retained securely by post bays 20 and canyon bays 22, as appropriate, at a relatively high density. However, vertical density can be optimized by using a somewhat different tray on top of each tray 10.

Figure 5:
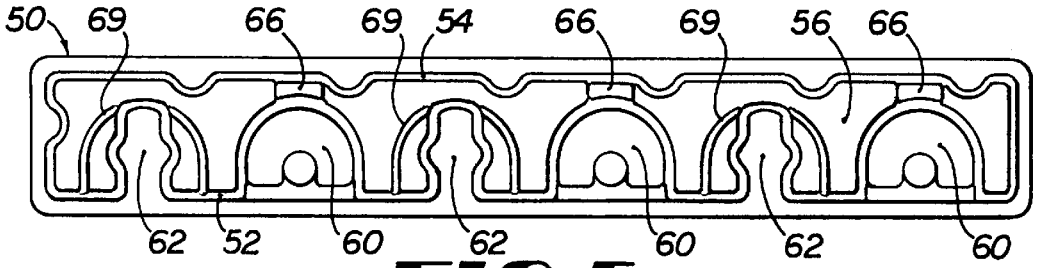
FIG. 5 is a top plan view of tray 50.
Figure 6:
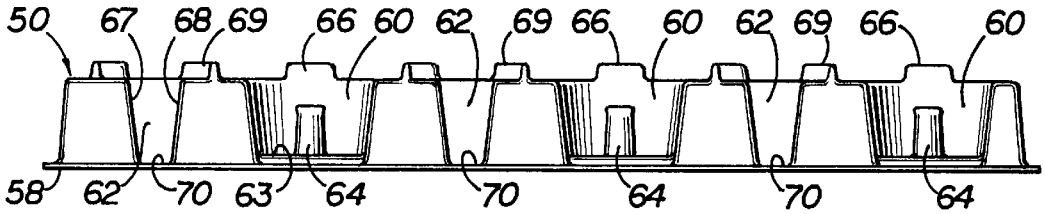
FIG. 6 is a front elevation view of the tray in FIG. 5.
Figure 7:
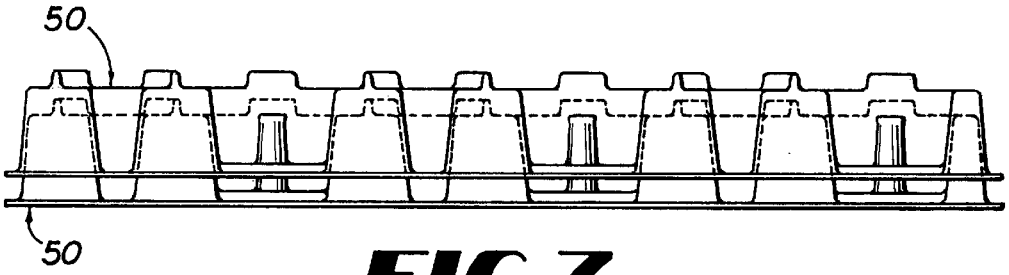
FIG. 7 is a front elevation of a tray 50 stacked on top of a tray 10.

The invention contemplates the stacking of trays one on top of another using interlocking members. Adverting to FIGS. 1 and 2, a tab 38 on top surface 16 extends upward near each post bay 20. Also, an arcuate member 40 on top surface 16 extends upward about two sides of canyon bay 22. The utility of these interlocking members will be discussed in greater detail below. FIGS. 5 and 6 show a second style of tray 50 which is substantially similar to tray 10. Tray 50 comprises front surface 52, rear surface 54, top surface 56 and bottom surface 58. Tray 50 has six alternating post and canyon bays, severally indicated at 60 and 62, respectively. Each post bay 60 comprises a base 63, a hollow post 64 and a tapering wall 65, and is associated with a tab 66 extending upward from top surface 56. Each canyon bay 62 comprises tapering walls 67 and 68 and is associated with an arcuate member 69 extending upward from top surface 56 and about three sides of canyon bay 62, and a base 70. However, the order of the post and canyon bays of tray 50 is reversed from that of tray 10. As shown in FIG. 7, when a tray 50 is positioned above tray 10, each arcuate member 40 of tray 10 interlocks with and retains a base 29 of a post bay 20 of tray 50. This interlocking prevents movement of tray 50 along the major (e.g., left-right) axis of tray 10 and also toward rear surface 54. When a tray 50 is placed on a tray 10, each tab 38 of tray 10 is positioned against the inner face of rear surface 54, preventing movement of tray 50 toward front surface 12. Thus, all horizontal movement of tray 50 in relation to tray 10 is prevented by the interlocking engagements of each arcuate member 40 and base 29 and tab 38 and the inner face of rear surface 54.

Figure 8:
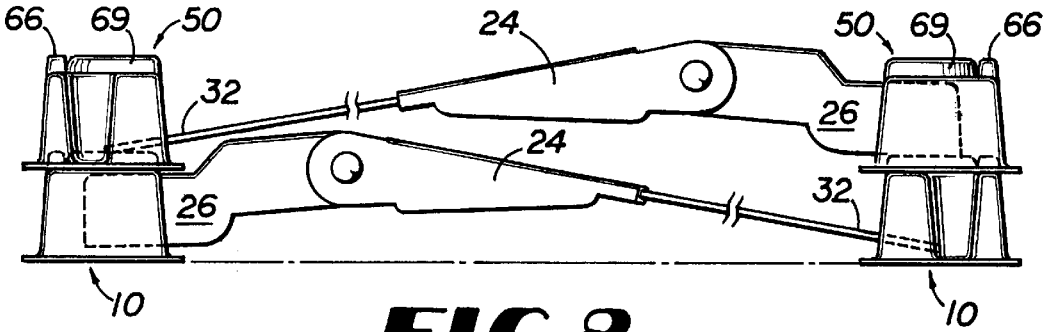
FIG. 8 is an end view of two pair of stacked trays supporting wiper arms.

Most significantly, the alternating stacking of trays 10 and 50 allows nesting of wiper arms 26 between the tray 10 layer and the tray 50 layer. As shown in FIG. 8, wiper arms 24 bend upward initially proceeding from end 26, and then bend back downward when approaching end 32. Stacking wiper arms 24 on top of one another with ends 26 over one another and end 32 over one another would reduce the vertical density of packing in order to take into account the upward bend near end 26. Instead, the invention uses the alternating nature of the bays in trays 10 and trays 50 to allow a downward bend near end 32 to index with an upward bend near end 26, and vice versa. Therefore, not only is the shape of tray 10 and tray 50 by themselves significant, but also the alternating, interlocking and nesting nature of tray 10 and tray 50 to cause a significant, vertical density.

The tray 50 layer in FIG. 8 would be followed with a tray 10 layer above it. The interlocking and nesting between the tray 50 layer and an upper tray 10 layer would be substantially identical to that between the lower tray 10 layer and the tray 50 layer. Adding and alternating layers can be continued until the strength limit of the tray material is reached. In this way, not only is the horizontal but vertical density of packing optimized.

MODIFICATIONS

Although the present invention has been described in terms of various preferred embodiments, it will be readily apparent that various modifications, substitutions, omissions, changes, and the like can be made without departing from the spirit thereof. For example, post and canyon bays have been described in this application. The configuration of the bays is driven by the shape of the ends of the objects to be retained, and the need to alternately stack and interlock with a next layer of trays. This may necessitate differently configured bays and interlocking means. One alternative configuration for a bay could be a friction fitting. That is, in canyon bay 22, walls 34 and 36 could be configured to prevent end 32 from being pressed down to rest on base 37. Instead, end 32 would be suspended above base 37. This would reduce the surface area of end 32 contacting tray 10 and reduce movement in all directions. Similarly, friction fittings could be used for the interlocking members of trays 10 and 50. That is, tabs 38 could engage correspondingly configured openings in bottom surface 58 of tray 50. Also, the post bay described herein could be modified such that post 30 has a circumference that prevents eye-hole 28 from sliding entirely down post 30, preventing end 26 from contacting base 29. This would further reduce the amount of contact between wiper arm 24 and tray 10. For this reason, the scope of the present invention should be limited only by the scope of the following claims, including equivalents thereof.

What is claimed is:

1. Dunnage for a product, comprising:

a set of first trays, each said first tray having a top, bottom, and side surfaces, said side surface including alternating, spaced first and second bays, wherein said first and second bays are configured differently from one another, said first bay configured to retain the first end of an object and said second bay configured to retain the second end of said object, said ends different from one another;

said first trays configured such that when said bays of two of said first trays are aligned with said bays opening toward one another, each first bay indexes with a second bay on said other first tray to form matched first/second bay pairs;

whereby objects having their first and second ends retained by first/second bay pairs are prevented from contacting one another.

2. The dunnage according to claim 1 wherein said first bay includes a post retaining member.

3. The dunnage according to claim 1 wherein said second bay closely emulates the shape of said second end.

4. The dunnage according to claim 1 wherein said second bay includes a friction fitting.

5. The dunnage of claim 1 wherein said top and bottom surfaces of said first tray include interlocking members associated with each said bay.

6. Dunnage for a product, comprising:

a set of first trays, each said first tray having a top, bottom, and side surfaces, said side surface including alternating, spaced first and second bays, said first bay configured to retain the first end of an object and said second bay configured to retain the second end of said object, said ends different from one another:

said first trays configured such that when said bays of two of said first trays are aligned with said bays opening toward one another, each first bay indexes with a second bay on said other first tray to form matched first/second bay pairs;

a set of second trays having a top, bottom, and side surfaces and alternating, spaced first and second bays in said side surface;

said top and bottom surfaces of said first and second bays having interlocking members associated with each bay;

said second trays configured such that when said bays of two of said second trays are aligned with said bays opening toward one another, each first bay indexes with a second bay on said other tray to form matched first/second bay pairs;

said interlocking members of said bottom surface of said second tray adapted to mate with the interlocking members of said top surface of said first tray when said second tray completely overlays said first tray;

said interlocking members of said bottom surface of said first tray are adapted to mate with the interlocking portions of said top surface of said second tray when said first tray completely overlays said second tray;

the orientation of said first/second bay pairs of said first tray layer are opposite that of the first/second bay pairs of said second tray layer;

whereby objects having their first and second ends retained by first/second bay pairs are prevented from contacting one another when placed in stacked sets of tray layers and lateral movement of said first and second trays in relation to one another is reduced and dense packing of said objects in the vertical direction is achieved.

7. The dunnage according to claim 6 wherein said objects are non-linear and symmetrical.

* * * * *